US006911176B2

(12) United States Patent
Saarinen

(10) Patent No.: US 6,911,176 B2
(45) Date of Patent: Jun. 28, 2005

(54) COOLING ELEMENT

(75) Inventor: Risto Saarinen, Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/415,600

(22) PCT Filed: Oct. 26, 2001

(86) PCT No.: PCT/FI01/00923

§ 371 (c)(1),
(2), (4) Date: Oct. 20, 2003

(87) PCT Pub. No.: WO02/37044

PCT Pub. Date: May 10, 2002

(65) Prior Publication Data

US 2004/0051218 A1 Mar. 18, 2004

(30) Foreign Application Priority Data

Nov. 1, 2000 (FI) ..... 20002408

(51) Int. Cl.[7] ..... C21B 7/10
(52) U.S. Cl. ..... 266/193; 266/194
(58) Field of Search ..... 266/193, 194, 266/241; 122/6 A, 6 B

(56) References Cited

U.S. PATENT DOCUMENTS

| | | | | |
|---|---|---|---|---|
| 4,335,870 A | | 6/1982 | Diener et al. | |
| 4,620,507 A | | 11/1986 | Saito et al. | |
| 4,676,487 A | * | 6/1987 | Kudinov et al. | 266/194 |
| 6,783,726 B2 | * | 8/2004 | Polvi | 266/193 |

FOREIGN PATENT DOCUMENTS

| | | |
|---|---|---|
| WO | WO 0046561 | 8/2000 |
| WO | WO 0050831 | 8/2000 |
| WO | WO 0163192 A1 | 8/2001 |

OTHER PUBLICATIONS

WPI/Derwent's abstract, Accession No. 1998–412006, week 199835, Abstract Of RU 2100728 (SEMENOV V N) Dec. 27, 1997.

* cited by examiner

*Primary Examiner*—Scott Kastler
(74) *Attorney, Agent, or Firm*—Morgan & Finnegan, L.L.P.

(57) ABSTRACT

The invention relates to a cooling element, in particular to be used in connection with furnaces and the like related to metal production processes, said element comprising a housing (1) provided with a channel system (2) for cooling water circulation. At least part of the cooling element surface that may get into contact with molten metal is made of steel.

12 Claims, 2 Drawing Sheets

COOLING ELEMENT

Figure 3:
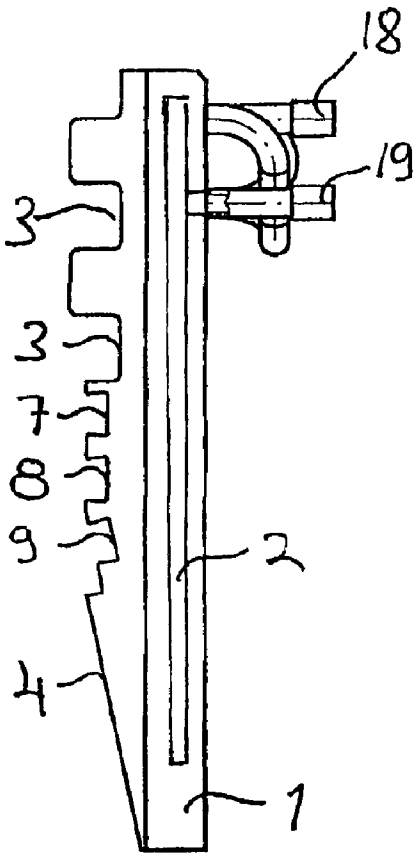

The present invention relates to a cooling element according to the preamble of claim 1.

In connection with furnaces used for industrial purposes, particularly in the manufacturing of metals, such as flash smelting furnaces, blast furnaces and electric furnaces or other metallurgic reactors, there are used cooling elements that are typically made of mainly copper. Typically these cooling elements are cooled by water and thus provided with a cooling water channel system, in which case the heat is transferred from the fire-resistant bricks in the furnace space, via the housing of the cooling element, to the cooling water. The working conditions are extreme, and the cooling elements are subjected, among others, to strong corrosion and erosion strains caused by the furnace atmosphere or molten contacts. For instance a brickwork, constituting the lining on the walls of the settler in a flash converting furnace, is protected by cooling elements, the task of which is to keep the temperature of the brickwork so low that the wearing of the bricks for reasons mentioned above is slow. However, the brickwork gets thinner in the course of time, and there may arise a situation where the molten metal gets into contact with the cooling element made of copper. Typically, in a direct molten contact, a cooling element made of copper does not endure the effect of the molten metal, particularly if the molten metal is flowing or turbulent, but it starts to melt, and this results in overloading the cooling power of the element and in subsequent damages. This may even lead to remarkable economic losses.

The object of the present invention is to realize a cooling element whereby the drawbacks of the prior art can be avoided.

The invention is characterized by what is set forth in the appended claims.

The arrangement according to the invention has several outstanding advantages.

By making at least part of the cooling element surface of steel, there is achieved a cooling element that endures a molten contact remarkably better than the prior art arrangements. By means of the invention, there are realized cooling elements with a remarkably improved resistance, particularly in applications where a contact between the cooling element and the molten metal is probable. The cooling element can be made completely out of steel, which is an advantageous arrangement with respect to the manufacturing technique. The housing of the cooling element can be made of copper, which has good thermal conductivity, in which case steel elements can be arranged on the element surface. By arranging the steel elements at fastening points, such as grooves, provided in the housing of the cooling element, there is obtained an extremely functional and effective fastening arrangement of the steel plates. When the steel surface is made of several separate elements, there is achieved an extremely functional arrangement with respect to both the manufacturing technique and to maintenance. As a whole, the invention improves productivity and safety.

Figure 5:
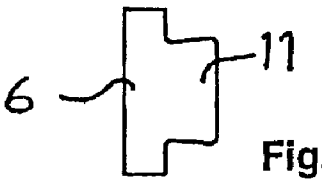
Figure 4:
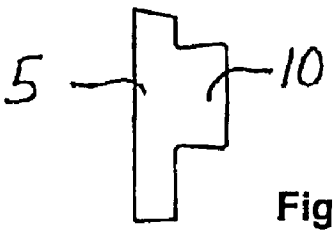
Figure 1:
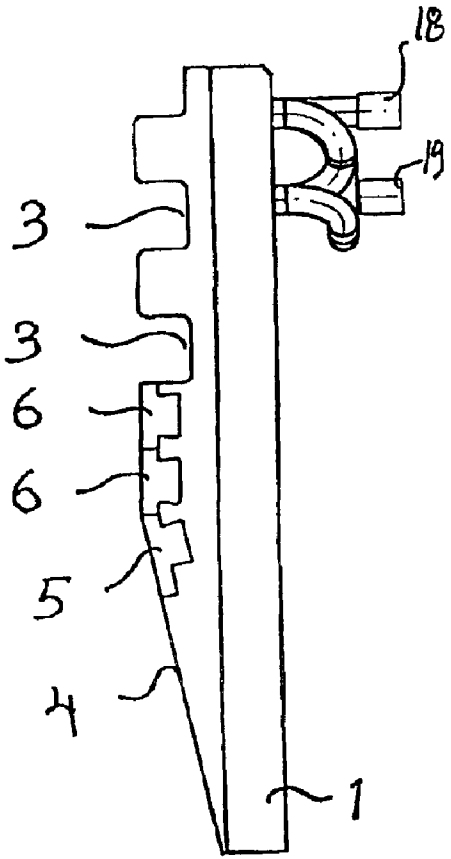
Figure 6:
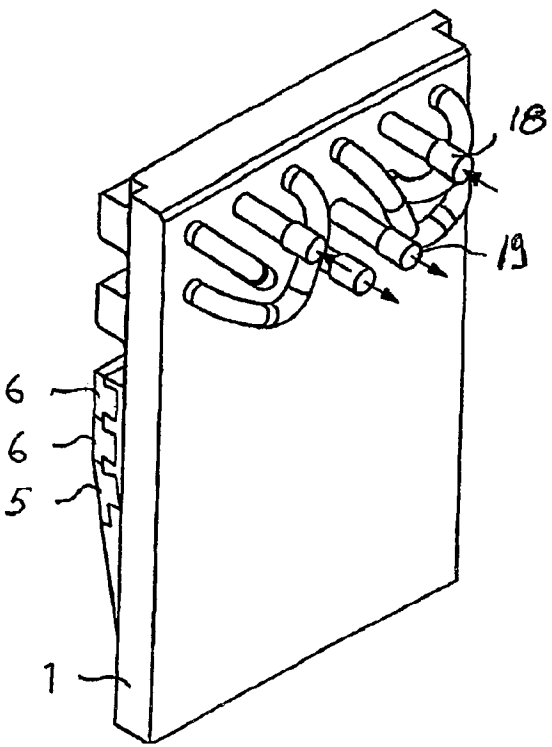
Figure 2:
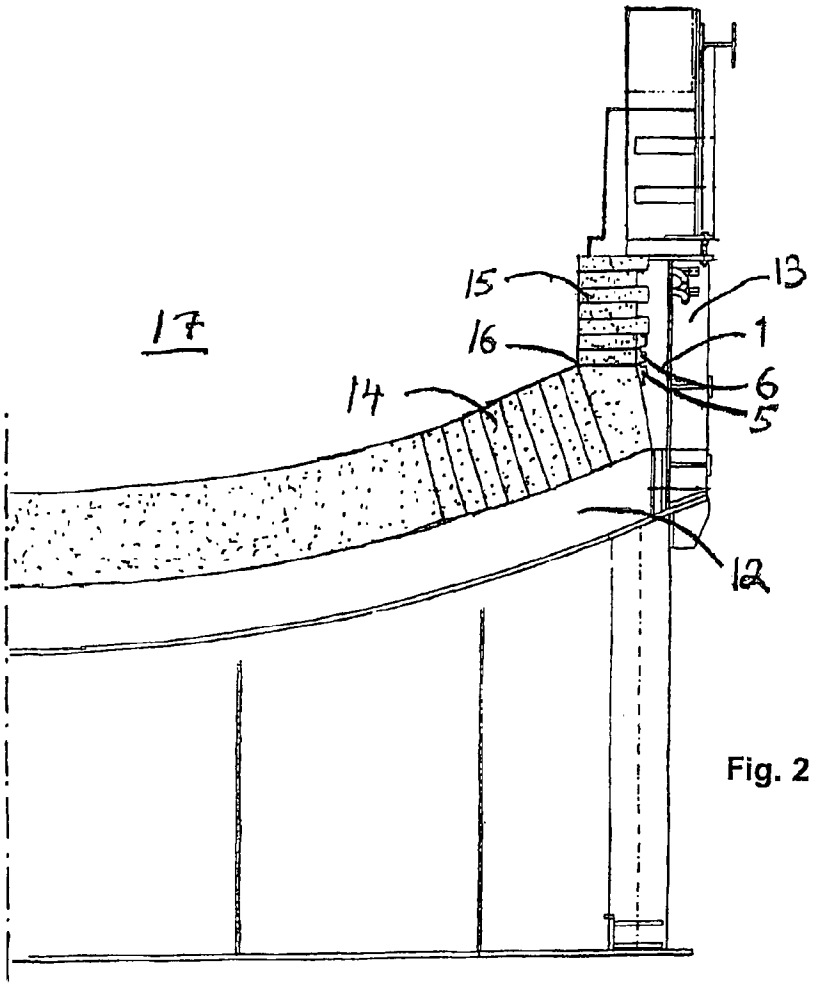

The invention is explained in more detail with reference to the appended drawings, where FIG. 1 illustrates a cross-section of a cooling element according to the invention, FIG. 2 illustrates a cross-section of the wall of a typical flash converting furnace, where a cooling element according to the invention is utilized, FIG. 3 illustrates a cross-section of the housing of the cooling element according to FIG. 1, FIG. 4 illustrates a cross-section of one structural part according to a the invention, FIG. 5 illustrates a cross-section of another structural part according to the invention, and FIG. 6 illustrates a cooling element according to the invention.

The cooling element according to the invention, particularly designed to be used in metal processes, in connection with furnaces and the like, comprises a housing 1 provided with a channel system 2 for the cooling water circulation. According to the invention, at least part of the cooling element surface, which may get into contact with the molten metal, is steel. The cooling element can be manufactured completely out of steel, or the housing part thereof can be made for instance of copper, in which case at least one steel element is arranged on the housing surface.

The cooling element according to the drawings comprises a housing 1, provided with a channel system 2 (FIG. 3) for cooling water circulation. Typically the housing 1 of the cooling element is made of copper, for instance. Advantageously the housing 1 of the cooling element is made for instance by casting, such as draw casting. In the housing 1, there is arranged a channel system 2 for the cooling agent circulation. Typically the channel system 2 is made by working, for instance by drilling, or in connection with casting. On that side 4 of the surface of the housing 1 that is placed in the furnace space, or at least on a part of said surface, there are typically made grooves 3, in which there can be placed parts of the ceramic lining of the furnace space, typically fireproof bricks. At least part of the element surface 4 on the side of the furnace space is provided with structural parts 5, 6, which are made of steel and are typically high-alloy steel elements. The steel elements 5, 6 are attached to the housing 1 of the cooling element, so that the heat contact between the housing and the steel plates is good, in which case the cooling effect of the cooling agent flowing in the cooling channel system 2 of the element prevents the molten metal, for example copper, from penetrating into the steel of the structural parts 5, 6. In the example according to the figures, on the element surface there are made grooves 7, 8, 9, advantageously horizontal grooves, in which the counterpart 10, 11 of the steel element is arranged to fit in (FIGS. 4 and 5). Typically the steel element serving as the structural part 5, 6 is arranged to remain advantageously based on the shapes therebetween in the grooves 7, 8, 9 of the housing. The grooves 7, 8, 9 can be designed to be for example narrowing from the groove bottom towards the element surface, in which case the width on the groove bottom is larger than the width on the surface level. In a typical embodiment, the groove width on the housing surface level is 2–10 mm narrower than the groove width on the groove bottom. The measure tolerance between the grooves and the steel plates is arranged to be such that the steel plates can be inserted in the grooves at the end thereof, from the side of the element housing.

The steel elements 5, 6 can be simply inserted in the grooves reserved for them, or they can be attached to the housing by another suitable fashion. In a preferred embodiment, the steel elements are attached to the housing by a diffusion joint.

According to another preferred embodiment, the whole cooling element is made of steel. This method results in a structure that is advantageous from the point of view of manufacturing technique. Advantageously the cooling element is made by casting, for example of heat resisting cast steel.

Typically the cooling elements are placed in the furnace walls so that at least the area that possibly gets into contact with molten metal is provided with a steel surface, typically particularly with steel elements 5, 6. According to FIG. 2, the cooling element is arranged in the area of the junction 16 between the lining 14, 15 of the bottom 12 and the sidewall 13 of the furnace, or in the vicinity of said junction. In FIG. 2, the furnace space 17 is located on the left-hand side with respect to the cooling element. Typically the area of the cooling element that is provided with a steel surface is for example in a flash converter furnace located in the border surface area between blister copper and slag. The shape and measures of the cooling element depend on the measure dimensions and type of the furnace.

The cooling element according to the drawings comprises an essentially straight wall directed away from the furnace space, in which wall the connections 18, 19 of the cooling channel system 2 are arranged. On the side 4 facing the furnace space 17, the bottom part of the cooling element narrows in a wedge-like fashion towards the bottom edge, in which case the element matches better the brickwork 14 of the curved bottom part 12 of the furnace. In the upper part of the element, there are made grooves for the fireproof lining 15 of the furnace wall. Now the steel surface of the cooling element is placed in the middle part of the element in the height direction thereof, when the elem nt is installed in place in the furnace wall.

The cooling elements according to the invention can be used in several different targets. A typical target of usage for the cooling element according to the invention is for instance the sidewalls of the furnace space of the settler in a flash converter furnace. Typical measures for the cooling element according to the invention are: width 0.25–1 m, length 1–2 m, thickness of the housing 100–200 mm, of which the thickness of the grooved part constitutes about half. Naturally the cooling element can also serve as the cooling element in some other furnace used particularly in metal production of refining processes. The shape and size of the cooling element are dependent on the target of usage in question. A preferred embodiment of the invention is an application where the element is a cooled so-called chute element, used particularly for conducting molten material. Now the surface layer can be arranged for example in the surface part that gets into contact with the molten material.

In a preferred embodiment, the steel surface of the cooling element according to the invention is made of heat resistive, high-alloy steel with high chromium content, typically of the order 20–30%, advantageously 24–28%. The suitability of the material in a particular target of usage according to the invention also is defined by the rest of the alloy ingredients of steel. A commercial steel type suited to be used in connection with the invention is for example GX40CrNiSi27-4. In that case the employed steel is heat resistant, high-alloy cast steel.

What is claimed is:

1. A cooling element, to be used in metal production in connection with a flash converting furnace, said element comprising a housing, provided with walls and with a channel system for circulation of cooling water, the cooling element being situated along a wall of the furnace to facilitate heat transfer between the furnace and the cooling element, such that a surface of said cooling element is located near a border between metal and slag within the furnace, the cooling element surface which, in use, may contact molten metal from the furnace, including at least one steel insert fitting into a groove provided in a wall of the housing and extending sufficiently outside of the wall of the housing to protect the cooling element from contacting the molten metal, the insert being situated along a wall of the furnace.

2. A cooling element according to claim 1, wherein the housing is mainly copper.

3. A cooling element according to claim 1, wherein the housing is mainly steel.

4. A cooling element according to claim 1, wherein the cooling element is provided with fastening surfaces for attachment of a ceramic lining of a wall of the furnace.

5. A cooling element according to claim 1, wherein the cooling element housing is provided with a fastening point for the at least one steel surface insert arranged in the groove of the housing.

6. A cooling element according to claim 5, wherein each steel insert has a portion, configured to match a respective fastening point in the cooling element housing, enabling attachment of each steel insert to the housing.

7. A cooling element according to claim 1, wherein each steel insert is attached to the housing by means of a diffusion joint.

8. A cooling element according to claim 1, wherein the employed steel is heat resistive, high-alloy cast steel.

9. A cooling element according to claim 1, wherein the chromium content of the steel is between 24% and 28%.

10. A cooling element according to claim 4, wherein the fastening surfaces are one or more substantially longitudinal grooves.

11. A cooling element according to claim 4, wherein the ceramic lining is a brick lining.

12. A cooling element according to claim 5, wherein the groove is a substantially longitudinal groove.

* * * * *